US007063172B1

(12) United States Patent
Marentette

(10) Patent No.: US 7,063,172 B1
(45) Date of Patent: Jun. 20, 2006

(54) GROUNDING ROD DRIVING DEVICE

(76) Inventor: Mark C Marentette, 3277 Bowerman Rd., Kingsley, MI (US) 49649-9651

( * ) Notice: Subject to any disclaimer, the term of this patent is extended or adjusted under 35 U.S.C. 154(b) by 0 days.

(21) Appl. No.: 10/746,974

(22) Filed: Dec. 24, 2003

(51) Int. Cl.
*E21B 7/02* (2006.01)

(52) U.S. Cl. ..... 173/184; 173/13

(58) Field of Classification Search ..... 173/184, 173/13, 14, 90, 91, 112, 114, 200
See application file for complete search history.

(56) References Cited

U.S. PATENT DOCUMENTS

| | | | | |
|---|---|---|---|---|
| 3,961,672 | A * | 6/1976 | Welsch et al. | 173/193 |
| 4,050,526 | A * | 9/1977 | Deike | 173/27 |
| 4,371,041 | A * | 2/1983 | Becker et al. | 173/28 |
| 5,040,927 | A * | 8/1991 | Wickberg | 405/232 |
| 5,107,934 | A * | 4/1992 | Atchison | 173/128 |
| 5,375,664 | A * | 12/1994 | McDowell et al. | 173/1 |
| 5,733,068 | A * | 3/1998 | Reinert, Sr. | 405/232 |
| 5,819,857 | A * | 10/1998 | Rohrer | 173/90 |
| 5,944,452 | A * | 8/1999 | Reinert, Sr. | 405/232 |
| 6,050,345 | A * | 4/2000 | Jarvinen et al. | 173/31 |
| 6,305,480 | B1 * | 10/2001 | Franklin | 173/27 |
| 6,349,777 | B1 * | 2/2002 | Burenga et al. | 173/187 |
| 6,702,037 | B1 * | 3/2004 | Thiessen | 173/89 |
| 2003/0178212 | A1 * | 9/2003 | Dennis | 173/89 |

OTHER PUBLICATIONS

Printout of Stanley Website showing GD48 and GD50 ground rod drivers, Copyright 2003.
Printout of specifications of GD50 ground rod driver, Apr. 2002.

* cited by examiner

*Primary Examiner*—Scott A. Smith
*Assistant Examiner*—Brian Nash
(74) *Attorney, Agent, or Firm*—Van Dyke, Gardner, Linn & Burkhart, LLP

(57) ABSTRACT

A driving assembly includes a driving device that is slidable along one or more vertical supports as the driving device drives a driving member into an object. The driving assembly may be suspended from a crane or other overhead support, whereby the vertical supports provide balance to the driving assembly and substantially maintain alignment of the driving device with the object. The driving device may slide downward along the vertical supports as the driving device drives against or into the object without requiring adjustment of the overhead support during the driving process. When the driving device has reached a lower portion of the vertical supports, the assembly may be repositioned to position the driving device at the upper end of the vertical supports and the driving process may be repeated. The driving assembly may drive grounding rods into the ground or may break up rock or concrete or the like.

13 Claims, 7 Drawing Sheets

GROUNDING ROD DRIVING DEVICE

FIELD OF THE INVENTION

The present invention relates generally to a device for driving a grounding rod into the ground and, more particularly, to a device for driving a ten foot or longer length of grounding rod into the ground. Aspects of the present invention may be suitable for other applications, such as rock breaking or the like.

BACKGROUND OF THE INVENTION

In order to provide sufficient grounding for some electrical systems, a grounding rod or metallic rod or bar for grounding the system may need to be driven a substantial amount down into the ground, sometimes up to thirty feet or more into the ground. In such situations where the grounding rod must be driven a substantial amount into the ground, multiple grounding rods may be connected together, such that a first grounding rod section may be driven into the ground a certain distance, such as approximately ten feet, and then a second grounding rod section may be placed on top of the first section and driven downward to drive the first section further into the ground. Additional sections may be connected together in a similar manner to drive the lower end of the grounding rod assembly a desired depth into the ground.

Typically, each section of grounding rod is approximately ten feet in length and, thus, extends a substantial amount above the ground at the onset of the driving process. In order to drive the grounding rod or grounding rod section into the ground, a jack hammer is often suspended above the grounding rod, such as via a chain or cable connected to a crane or the like, and activated to hammer or pound or impact the grounding rod to drive the grounding rod into the ground. However, such an approach may cause excessive wear and damage to the jack hammer, because the jack hammer repeatedly impacts the upper end of the grounding rod and may bounce and vibrate as the end of the jack hammer impacts the end of the grounding rod.

Such an approach also typically encounters difficulties in maintaining alignment of the jack hammer with the end of the grounding rod, since the jack hammer is typically suspended from a crane or boom by a hook and chain or line and, thus, is generally free to swing back and forth as the jack hammer impacts and bounces off of the grounding rod. It is also difficult to maintain alignment of the jack hammer with the grounding rod because the jack hammer must be continually lowered by the crane and aligned or repositioned at the upper end of the grounding rod as the grounding rod is driven into the ground. The crane operator thus must substantially continually adjust the position of the crane as the crane and jack hammer are lowered to maintain alignment of the jack hammer with the end of the grounding rod. This is especially difficult because the crane operator typically has to both lower the jack hammer and move the jack hammer laterally to accommodate the arcuate lowering of the jack hammer by the crane. Also, a person or operator typically has to manually hold the grounding rod in place as the jack hammer is hammering or pounding the grounding rod into the ground, in order to limit or reduce misalignment of the grounding rod during the driving process. Such a manual holding operation may be difficult and painful to the operator holding the grounding rod as the grounding rod is pounded and hammered by the jack hammer.

Therefore, there is a need in the art for a grounding rod driving device that is easier to align with the grounding rod and that effectively and efficiently drives the grounding rod into the ground and overcomes the shortcomings of the prior art driving devices or systems.

SUMMARY OF THE INVENTION

The present invention provides a grounding rod driving machine or assembly or system that is operable to drive a grounding rod into the ground and maintain alignment of the grounding rod driving machine with the grounding rod during the driving process. The grounding rod driving machine of the present invention also limits or reduces the amount of repositioning or adjustment of the driving machine by an operator during the driving process to substantially ease the driving process. Aspects of the present invention are equally suitable for other applications, such as for breaking rocks or concrete or the like with the driving device of the present invention.

According to an aspect of the present invention, a driving machine or assembly for driving a driving member against an object includes at least one support member and a driving device. The support member is supportable by a support structure. The driving device is slidably mounted to the support member and is slidable along the support member. The driving device is operable to drive the driving member downward to drive the driving member against an object to move or break the object. The driving device slides along the support member as the driving member is driven against the object and the object is moved or broken. The support member and the driving device are configured to maintain alignment of the driving member with the object during operation of the driving machine.

The at least one support member may comprise a pair of support members, and the driving device may be slidably mounted between the support members. The support member or members may be configured to be suspended from an overhead support, such as a crane or the like. The support member or members may be balanced to maintain a generally vertical orientation during operation of the driving machine and while the support members are suspended from the crane or overhead support. Optionally, the driving device may be slidably positioned along a generally fixed vertical post or support member, such as on the back of a wheeled vehicle, such as a trailer or truck or the like, to provide a driving assembly that may drive the driving member into the object without requiring a crane to support or suspend the driving device or assembly above the object. Optionally, the at least one support member may be pivotally mounted to the wheeled vehicle.

The driving member may comprise a rod driving member that is configured to engage an end of a grounding rod to drive the grounding rod into the ground. Optionally, the driving member may comprise a rock breaking member that is configured to engage and break rock or concrete or the like, or the driving member may comprise other forms of driving members for engaging and driving or breaking or impacting other objects, without affecting the scope of the present invention.

According to another aspect of the present invention, a method of driving a driving member against an object to move or break the object includes providing a driving machine or assembly having at least one support member and a driving device slidably mounted to the support member and slidable along the support member. The driving device is operable to drive the driving member downward to drive the driving member against an object to move or break the object. The driving device is positioned at an upper portion of the support member and the support member is positioned such that the driving member is generally aligned with the object. The driving device is actuated to repeatedly impact the object with the driving member. The driving device slides downward along the support member as the driving member is driven against the object and the object is moved or broken. The support member is repositioned relative to the driving device and the object such that the driving device is positioned at the upper portion of the support member. The driving device is activated and the driving device slides downward along the support member as the driving member is further driven against the object and the object is further moved or broken.

The support member may comprise an elongated member, and the driving device may slide downward along the support member at least approximately twenty inches before the support member is repositioned. The support member may include a stop at a lower portion to limit downward movement of the driving device relative to the support member. The steps of repositioning the support member and continuing actuation of the driving device may be repeated to drive the driving member against the object to further move or break the object.

Therefore, the present invention provides a grounding rod driving machine or system or assembly that substantially maintains alignment of the driving device with the grounding rod during the driving process. The vertical support members or posts are weighted and balanced to maintain a generally constant vertical orientation while the driving device may slide downwardly along the support members during the driving process. The vertical support members may be of sufficient length to allow for a substantial amount of driving of the grounding rod without requiring adjustment or realignment or movement of the support members, such that the grounding rod driving assembly may only require adjustment by a crane operator or the like after the driving device has reached the lower end of the support members. For example, the grounding rod driving assembly of the present invention may only require repositioning or adjustment by a crane operator or the like after about thirty inches or so of downward driving of the grounding rod, such that the driving assembly may require repositioning only three or four times during the driving of a ten foot grounding rod. The present invention thus provides a substantial improvement to the crane operator, who no longer has to continually adjust the crane's position during the driving process. Also, the driving assembly of the present invention limits or substantially reduces the wear on the driving motor or device, since the driving device no longer bounces and swings during the driving process and, thus, may have a substantially longer life cycle than the jack hammers of the prior art driving systems and processes.

These and other objects, advantages, purposes and features of the present invention will become apparent upon review of the following specification in conjunction with the drawings.

BRIEF DESCRIPTION OF THE DRAWINGS

FIG. 8 is a side elevation of a driving bit suitable for use with the driving assembly to break rocks or concrete or the like;

DESCRIPTION OF THE PREFERRED EMBODIMENTS

Figure 1:
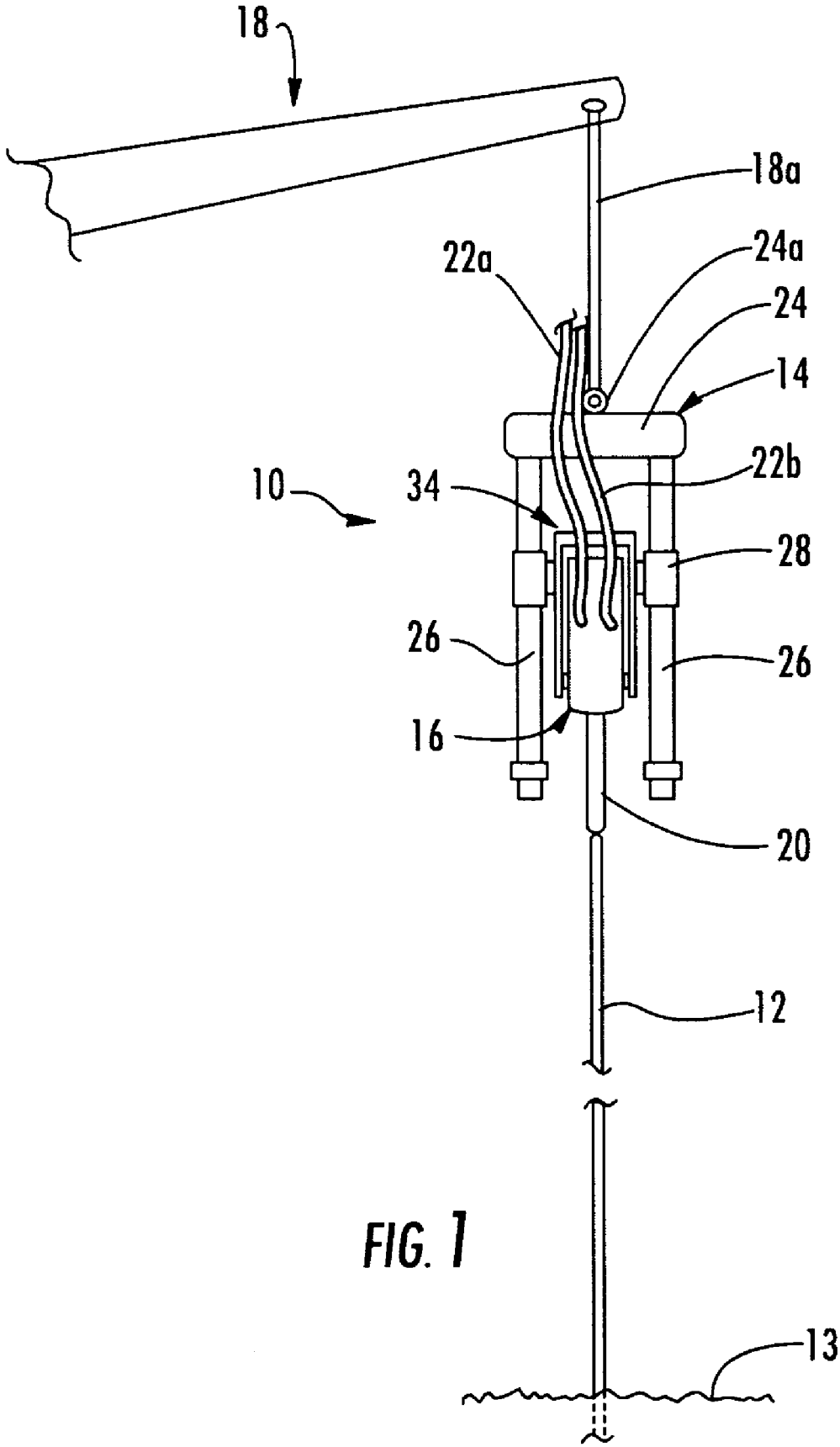
FIG. 1 is a side elevation of a grounding rod driving assembly in accordance with the present invention, shown suspended from a crane above a grounding rod.
Figure 9:
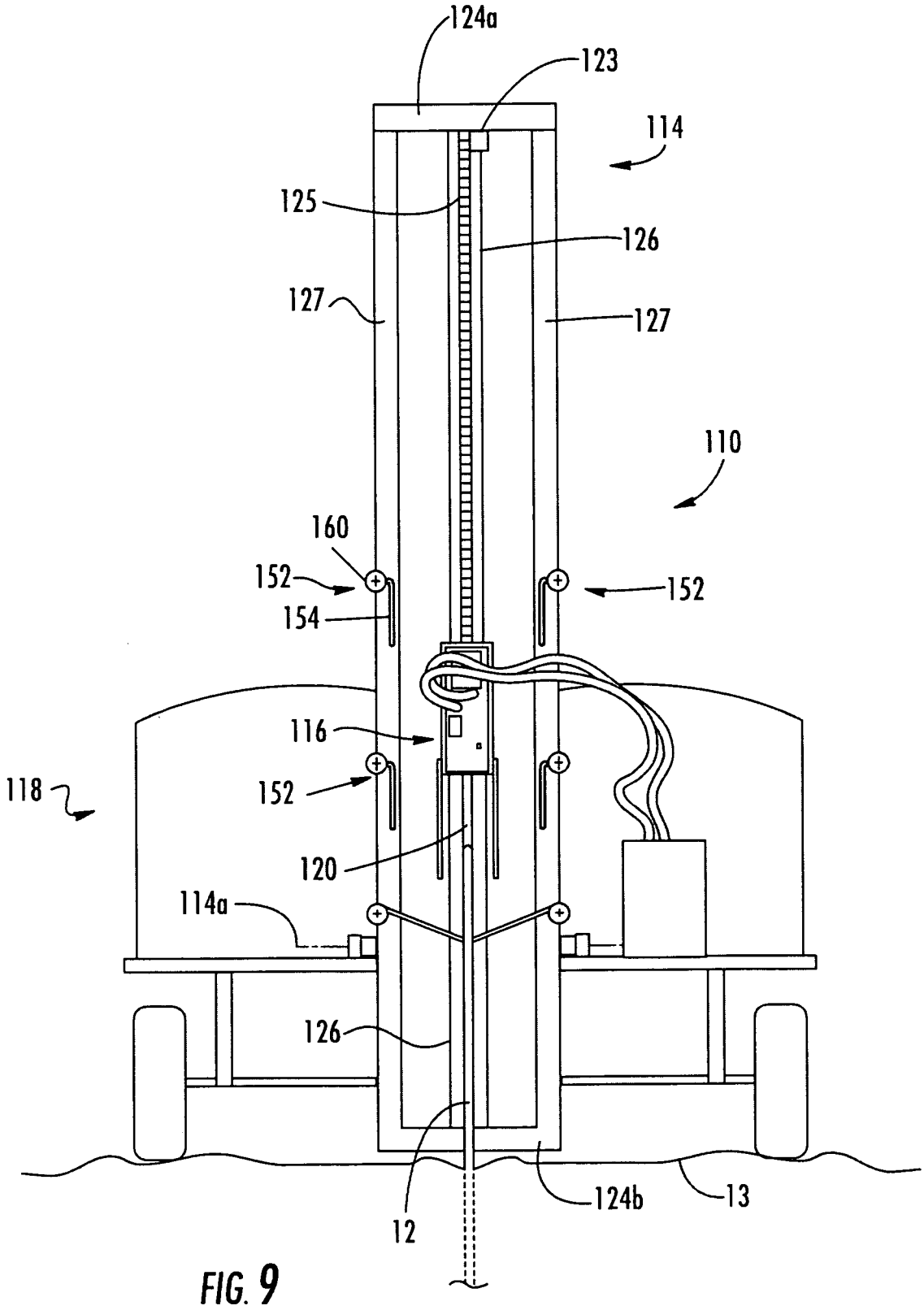
FIG. 9 is a grounding rod driving assembly in accordance with the present invention, with the driving device and vertical supports mounted to a wheeled vehicle.

Referring now to the drawings and the illustrative embodiments depicted therein, a grounding rod driving machine or assembly 10 is operable to drive or pound or hammer a grounding rod 12 into the ground 13 (FIG. 1). Driving assembly 10 includes a frame portion 14 and a driving device 16 that is slidably mounted to frame portion 14 and slidable therealong as driving assembly 10 drives grounding rod 12 into the ground. Driving assembly 10 may be supported above grounding rod 12 by an overhead support or structure 18, such as a crane (as shown in FIG. 1) or the like, or may be mounted to a movable or wheeled platform or vehicle 118 (as shown in FIG. 9 and discussed below). Frame portion 14 functions to maintain alignment of driving device 16 with grounding rod 12 as driving device 16 is actuated and impacts and hammers and drives grounding rod 12 into the ground 13. Driving assembly 10 may drive grounding rod 12 into the ground as driving device 16 slides downward along frame portion 14, while frame portion 14 is supported at a particular location by overhead support 18. After driving device 16 has reached the lower end of frame portion 14, the overhead support or crane 18 may be adjusted or repositioned to reposition frame portion 14, such that driving device 16 is positioned at an upper end of frame portion 14 and may drive the grounding rod further down into the ground, as discussed below. Driving assembly 10 thus may drive a grounding rod a substantial amount into the ground, while maintaining alignment of the driving device with the grounding rod and without requiring continuous adjustment or repositioning of the driving assembly during the driving process.

Driving device 16 is operable to oscillate or drive a driving member or bit 20 up and down to repeatedly impact and hammer the grounding rod 12 into ground 13. Driving device 16 may comprise a hydraulic motor device that is driven via pressurized hydraulic fluid in hydraulic lines 22*a*, 22*b*, which may be connected to a pump and motor at the crane 18 or otherwise remote from the driving assembly 10. The pressurized fluid in hydraulic lines 22*a*, 22*b* may cause the oscillation of the driving bit 20, and may be controlled by controls or switches or solenoid valves at the driving machine or at the crane or the like. Driving device 16 may include a nitrogen filled chamber that may function to assist in driving the bit 20 downward to drive the bit hard and fast in the downward direction to hammer the grounding rod into the ground. As the bit 20 impacts and hammers and drives grounding rod 12 into the ground, driving device 16 may move or slide downward along frame portion 14 of drive assembly 10, while frame portion 16 maintains general alignment of bit 20 with grounding rod 12 during the driving process, as discussed below.

Frame portion 14 includes an upper cross member 24 and a pair of side vertical supports or posts 26 extending downward from cross member 24. Cross member 24 may include a hook or eye 24*a* or the like at an upper end of cross member 24 for receiving a hook or cable or chain or the like 18*a* of the overhead support or crane 18. Frame portion 14 thus may be suspended from an end of overhead support or crane 18 via the chain or cable 18*a* engaging the hook 24*a* of cross member 24, as shown in FIG. 1. Support posts 26 may be welded to or otherwise secured to cross member 24.

Figure 3:
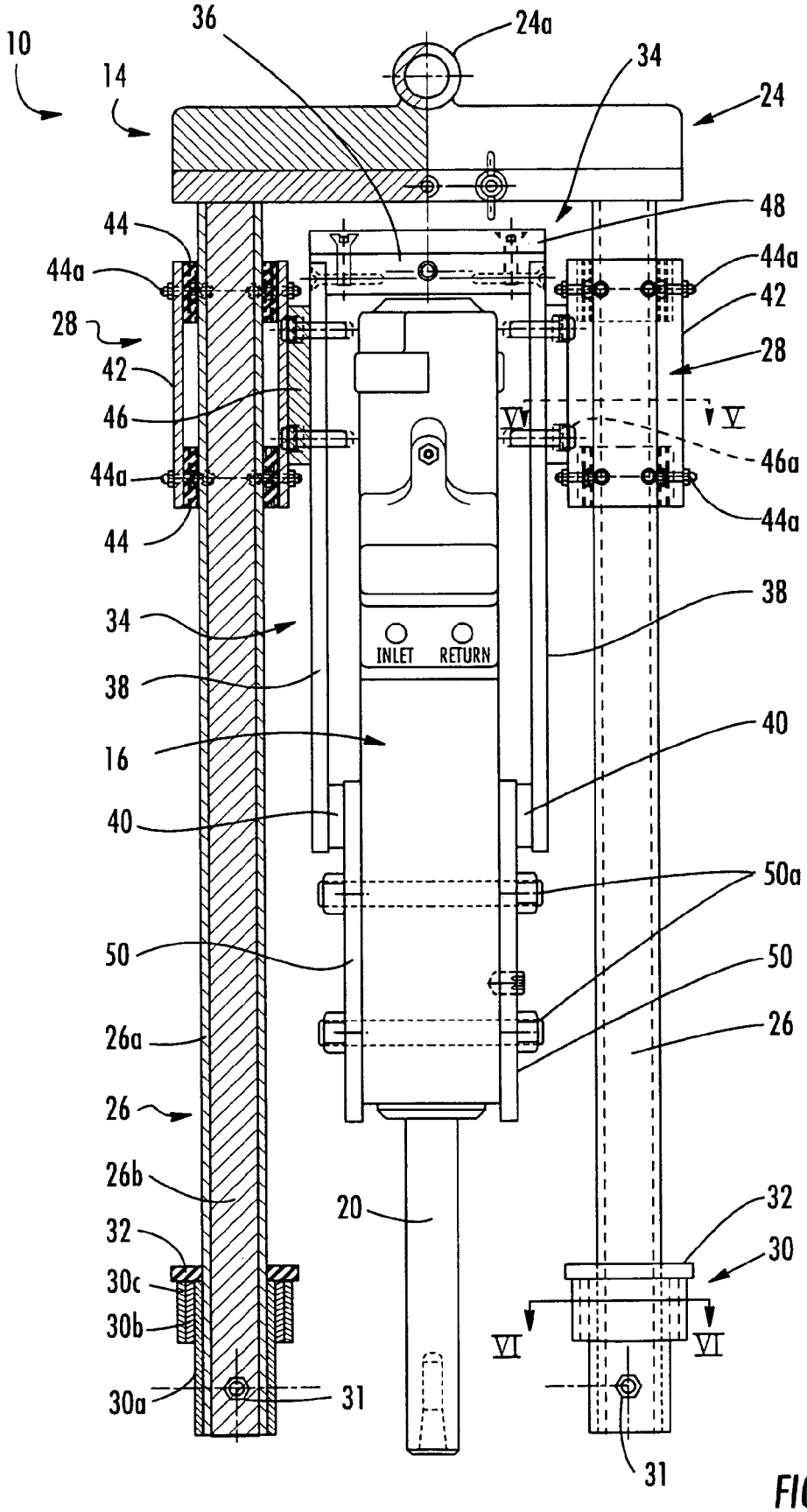
FIG. 3 is a front elevation and partial sectional view of the grounding rod driving assembly of FIG. 2.
Figure 5:
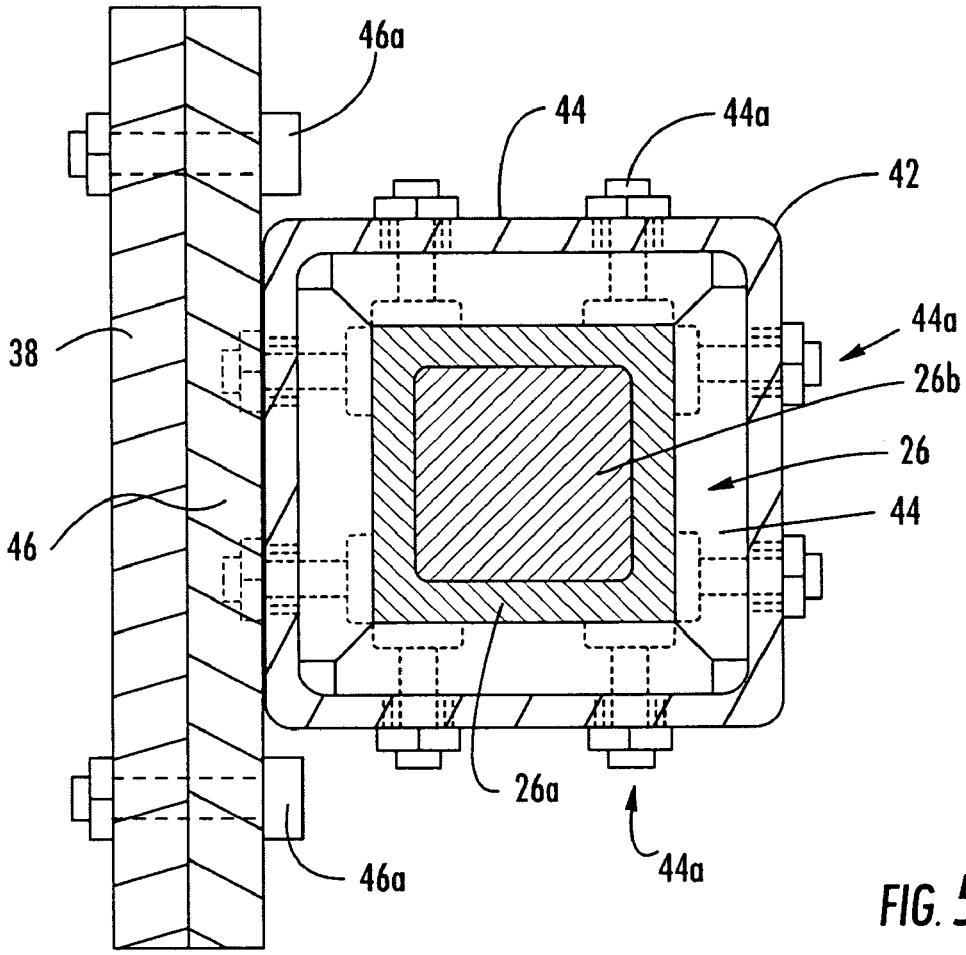
FIG. 5 is a sectional view of the slide assembly of the grounding rod drive assembly, taken along the line V—V in FIG. 3.
Figure 6:
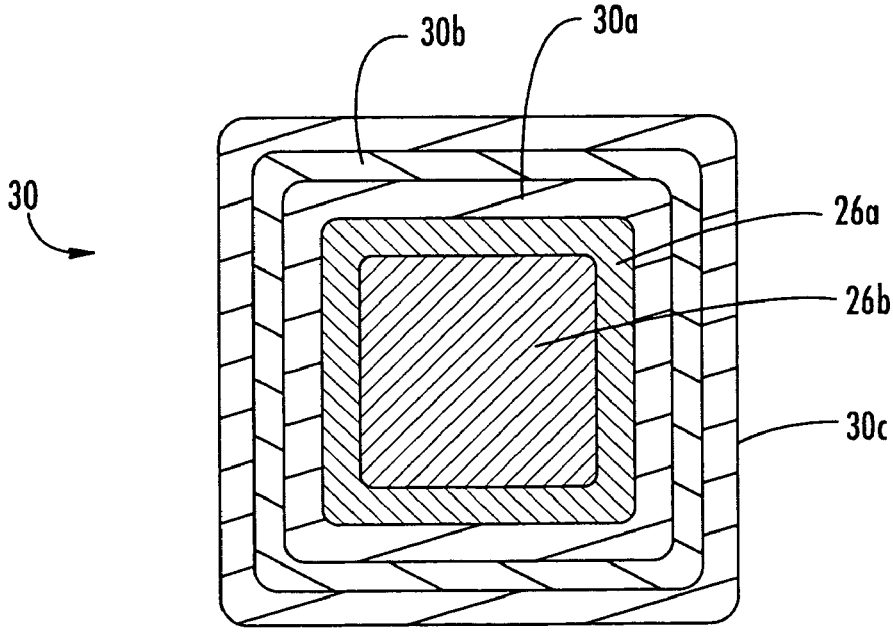
FIG. 6 is a sectional view of the lower portion of the support rods of the grounding rod drive assembly, taken along the line VI—VI of FIG. 3.

Vertical support posts or members 26 extend downwardly from cross member 24 and are received through sliding collars or collar assemblies 28 attached to driving device 16, as discussed below. Vertical supports 26 are generally balanced and weighted rods or posts, such that the supports 26 are substantially balanced and maintained in their generally vertical orientation while driving device 16 hammers and drives grounding rod 12 into the ground. In the illustrated embodiment, and as shown in FIGS. 3, 5 and 6, vertical supports 26 comprise a hollow square steel stock 26*a*, with a solid steel stock 26*b* inserted or received therein. For example, the outer or hollow steel tubing may have a width of approximately two inches, while the inner or solid square stock 26*b* may have a width of approximately one and a half inches and may be received within the outer tubing 26*a*. However, other shapes and materials may be implemented to form the vertical supports, without affecting the scope of the present invention. The vertical supports 26 thus may comprise substantially solid vertical supports extending downward from cross member 24 and may be substantially the same overall length and weight. The substantially solid supports are secured to and suspend from cross member 24 and function to maintain the frame portion 14 substantially balanced such that supports 26 are in a generally vertical orientation throughout the operation of the driving assembly.

Figure 4:
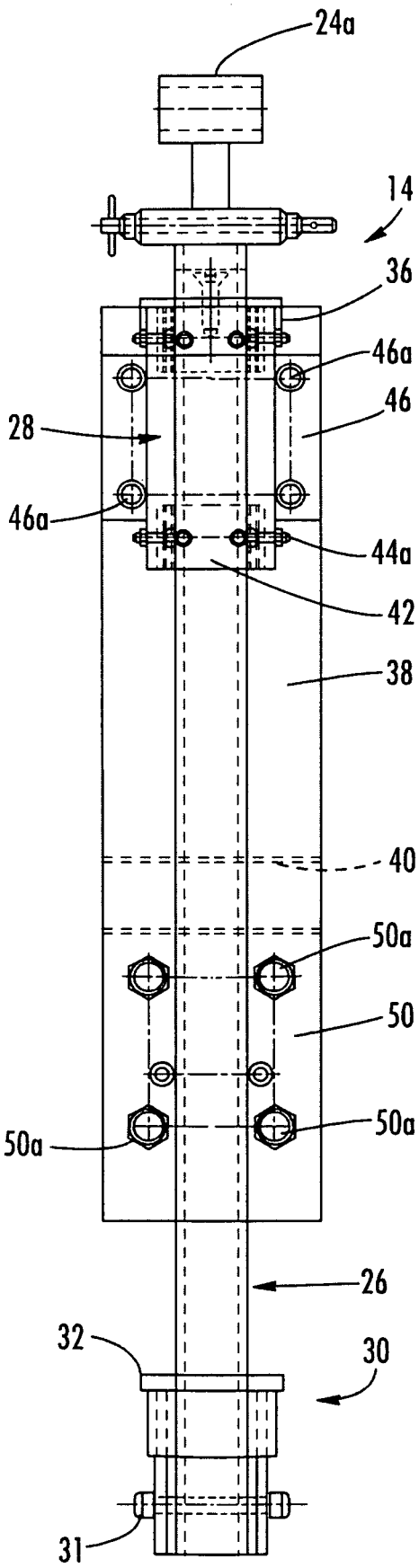
FIG. 4 is a side elevation of the grounding rod driving assembly of FIGS. 2 and 3.
Figure 2:
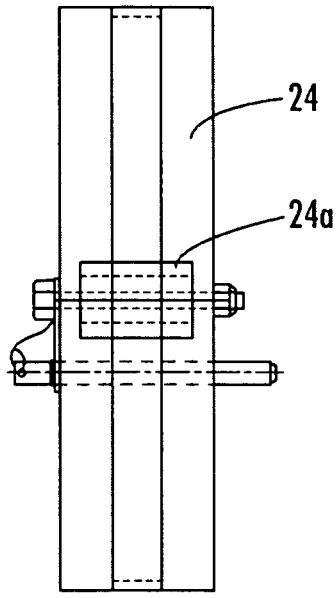
FIG. 2 is a plan view of the grounding rod driving assembly of the present invention.

The lower ends of vertical supports 26 may have a weighted foot assembly or lower stop 30, in order to weight the lower ends of vertical supports 26 to assist in maintaining the generally vertical orientation of the vertical supports 26 during the driving process, and in order to limit downward movement of the driving device 16, as discussed below. Each foot assembly 30 may include multiple larger hollow, steel tubing sections 30*a–c*. For example, and as best shown in FIGS. 3 and 6, each foot assembly 30 may include an inner tubing section 30*a*, which receives the lower end of vertical support 26 therethrough, a middle tubing section 30*b*, which receives the inner tubing section 30*a* therein, and an outer tubing section 30*c*, which likewise receives the middle tubing section 30*b* therein. The middle and outer tubing sections 30*b* and 30*c* may be welded or otherwise secured to each other and to the inner tubing section 30*a*, which may be secured to the lower end portion of vertical support 26, such as via a fastener 31 extending through the lower end of the support and through the inner tubing section, as shown in FIGS. 3 and 4. The foot assemblies 30 of vertical supports 26 thus may provide additional weight at the lower ends of the vertical supports to maintain the vertical supports in their substantial vertical orientation during the driving process.

Each foot assembly 30 may also function to provide a stop to limit downward movement of driving device 16 relative to vertical supports 26 as driving device 16 reaches the downward limit of its travel relative to vertical supports 26. For example, each foot assembly 30 may further include a rubber stop member 32 positioned at an upper end of foot assembly 30 and around vertical support 26 to limit downward movement of the collar assemblies 28 and to absorb the shock of the collar assemblies impacting the foot assemblies when the driving device 16 reaches the downward limit relative to vertical supports 26.

Driving device 16 thus may be secured to collar assemblies 28 and may move downward along vertical supports 26 as bit 20 is driven into grounding rod 12. Driving device 16 may be mounted to or supported by a body portion or mounting frame 34, which may in turn be secured to the collar assemblies 28, which may slide along vertical supports 26 during the driving process. As best shown in FIG. 3, mounting frame 34 includes an upper cross member or plate 36 and a pair of downwardly extending side plates 38. The lower ends of side plates 38 may be welded or otherwise secured to driving device 16, such as via respective mounting plates or spacers 40, while the upper portions of side plates 38 may be secured to the respective collar assemblies 28.

As best shown in FIGS. 3 and 5, each collar assemblies 28 may include a hollow steel tubing or outer tube 42 and one or more sliding plates or members 44 positioned generally within outer tube 42 and between outer tube 42 and vertical support 26. As shown in FIG. 5, the sliding members 44 may be arranged at each side of the vertical support 26 to define a sliding collar assembly around vertical support 26 to facilitate sliding of collar assembly 28 along vertical support 26. Sliding members 44 may comprise a non-metallic material that may provide a low coefficient of friction sliding surface to enhance sliding of the sliding members 44 and collar assembly 28 along the outer surface of the steel tubing 26*a* of vertical support 26. For example, sliding members 44 may comprise a Teflon material or an ultra high molecular weight (UHMW) polyethylene material or the like. The sliding material facilitates smooth sliding of collar assemblies 28 along vertical supports 26 to provide smooth downward movement of driving device 16 relative to vertical supports 26 during operation of driving machine 10. As can be seen in FIG. 5, sliding members 44 may comprise four separate plates that may be secured to the respective side portions of the outer tube 42, and may have chamfered or tapered edges to allow the plates to be positioned at or abutted against one another at the corners of the outer tube 42. Optionally, however, the sliding members or plates may comprise a single sliding collar positioned within and secured to the outer collar tubular section 42, or vertical supports 26 may comprise an outer low coefficient of friction surface or sliding plate therearound to be slidably received within the collar tubular section, without affecting the scope of the present invention. Each of the sliding plates or members 44 may be secured to or bolted to the outer tube 42, such as via one or more fasteners or bolts 44*a* extending therethrough. As shown in FIG. 3, the sliding plates or members 44 may be positioned at both an upper end and a lower end of each of the collar assemblies 28 to limit potential twisting or binding of the collar assemblies as they slide along supports 26.

Outer tube 42 of each collar assembly 28 may be welded to a respective spacer or mounting plate 46 along one side of the outer tube 42 for mounting the collar assembly 28 to mounting frame 34 of driving device 16. As shown in FIGS.

3 and 5, each spacer plate 46 may be fastened or secured to side plate 38 of mounting frame 34 via one or more bolts or fasteners 46*a*, such that side plate 38 of mounting frame 34 is substantially fixedly secured to the respective collar assembly 28.

Driving device 16 is secured at spacers 40, such as via welding or other fastening or securing means, such that driving device 16 is secured to the lower ends or portions of side plates 38 of mounting frame 34. The upper ends of side plates 38 are fastened to or secured to or welded to cross member 36 of mounting frame 34, which may extend over the upper portion of driving device 16 to generally fixedly connect the side plates 38 together. A rubber or elastomeric stop member 48 may be secured to an upper surface of upper plate or cross member 36 to absorb any impact between mounting frame 34 and cross member 24 as driving device 16 and mounting frame 34 are raised upward relative to vertical supports 26 and cross member 24 of frame portion 14.

As shown in FIG. 3, spacers 40 may be welded to respective lower side plates or cover plates 50, which may be secured to the lower end of driving device 16 via one or more fasteners or bolts 50*a* (such as the four fasteners shown in FIG. 4) extending through cover plates 50 and the lower end portion of driving device 16. The fasteners 50*a* and cover plates 50 may be removed to remove the driving device 16 from the mounting frame 34 and to provide access to the driving device, such as for changing the driving member or bit 20 or for servicing the driving device 16 or the like.

During operation of driving assembly 10, the driving assembly 10 may be raised to a position above a grounding rod 12, such as via a crane 18 or the like. When drive assembly 10 is positioned such that bit 20 is generally aligned with the upper end of the grounding rod, driving device 16 may be actuated to oscillate driving bit 20 up and down to impact and hammer and drive the grounding rod downward into the ground. As the bit 20 impacts the grounding rod, the driving assembly 10 may absorb the impact by the driving device 16 sliding upward along the supports 26, while remaining aligned with the grounding rod. As the grounding rod is driven downward, driving device 16 may slide downward along vertical supports 26, such that driving device 16 may continue to impact or hammer the upper end of the grinding rod with bit 20 as the grounding rod is driven into the ground. Vertical supports 26 are generally or substantially balanced and weighted and may be positioned in a generally vertical orientation, such that the vertical supports function to maintain their generally vertical alignment or orientation during the driving process, thereby limiting or substantially precluding excessive vibration and bouncing or other unwanted movement of the driving device 16 during the driving process. The balanced and weighted frame portion and vertical supports thus may remain in a substantially stationary position as the driving device drives the grounding rod into the ground and slides downward along the vertical supports of the driving assembly. The driving device may continue to drive the grounding rod downward a desired or appropriate amount, or until the collar assemblies 28 contact the elastomeric or rubber stops 32 at the foot portions or assemblies 30 of the supports 26.

In the illustrated embodiment, the travel distance or stroke of the driving device along the supports 26 is approximately thirty inches between an upper position, where the upper stop 48 of mounting frame 34 may approach or contact cross member 24, and a lower position, where the collar assemblies 28 may contact the lower stops 32 of vertical supports 26. However, the length of the support members may be other lengths to provide more or less travel of the driving device along the supports or support members, without affecting the scope of the present invention.

After the driving device has driven the grounding rod down the entire length or stroke (or substantially the entire length or stroke) of the vertical supports (such as, for example, approximately thirty inches), the overhead support or crane 18 may be lowered and repositioned and adjusted, such that driving device 16 is again positioned at the upper end of the vertical supports 26, with driving bit 20 being generally aligned with the upper end of the grounding rod. Driving device 16 may again be actuated to continue driving the grounding rod 12 down into the ground, while driving device 16 again slides downward along the vertical supports 26 until the driving device has traveled a desired or appropriate amount or until the collar assemblies again contact the lower stops. The frame portion 14 may again be repositioned by the crane or the like to position the driving device at the upper region of the frame portion, and the process may be repeated until the grounding rod is driven the desired or appropriate amount into the ground. If further depth of the grounding rod is desired, a second grounding rod section may be placed on top of the first section and the driving assembly may be raised to be positioned above and generally aligned with the upper end of the second section, whereby the driving process may continue to drive the grounding rod sections further into the ground until the grounding rods reach the desired or appropriate depth.

Because of the length of the vertical supports 26, the driving device 16 may drive the grounding rods a substantial amount into the ground without requiring adjustment or repositioning of the overhead support or crane 18. In the illustrated embodiment, the vertical supports 26 provide approximately thirty inches of travel of the collar assemblies 28 and thus of the driving device relative to the frame portion 14. Accordingly, the driving assembly of the present invention may drive a ten foot grounding rod into the ground, while only requiring adjustment or repositioning of the crane and driving assembly three times during the entire driving process for the ten foot grounding rod (with the vertical supports providing approximately thirty inches of travel or stroke of the driving device before repositioning is necessary). However, the vertical supports may be formed to be other lengths to provide more or less of a driving stroke of the driving device, without affecting the scope of the present invention.

Figure 7:
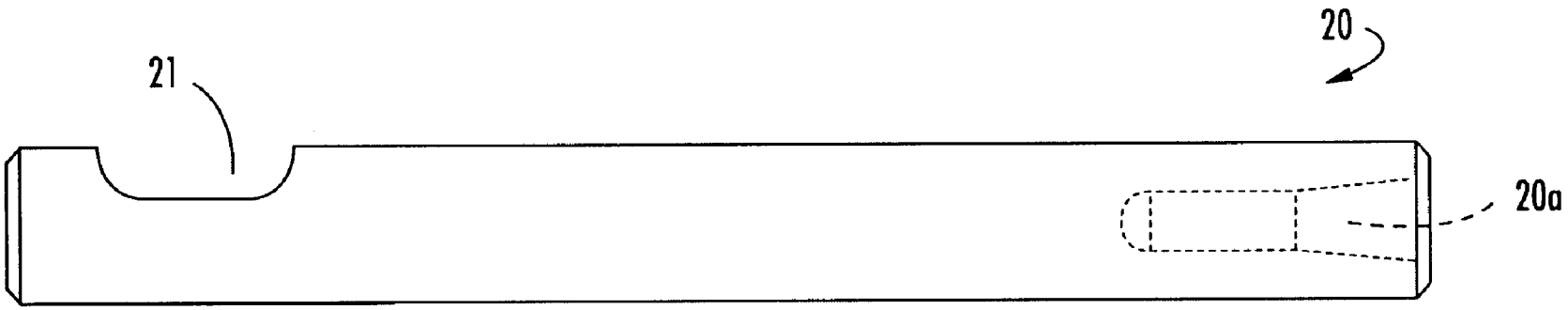
FIG. 7 is a side elevation of a driving bit suitable for use with the driving assembly to drive a grounding rod into the ground.

As is known in the art, grounding rods often have a tapered or pointed or narrowed end and a flared and partially hollowed end, such that a grounding rod may be positioned on top of another grounding rod, where the flared end may partially receive the tapered end of the other grounding rod to connect the grounding rods together. One or both of the ends may have grooves along the surface of the end to facilitate biting into the material of the other grounding rod to ensure a sufficient grounding connection between the grounding rods as they are hammered and driven and joined together. As shown in FIG. 7, the driving bit 20 may include a hollow end 20*a* for receiving the tapered or pointed or narrowed end of the grounding rod to assist in aligning the driving bit 20 with the grounding rod 12 and to assist in maintaining such an alignment during the driving process. The end of the driving bit 20 may further include a chamfered opening to facilitate guiding the end of the grounding rod into the hollowed end 20*a* of driving bit 20. Because grounding rods may have different shapes or tapers or sizes, the driving bit may be replaced with a different driving bit to accommodate different grounding rods. For example, driving bit 20 may have an internal channel that has a diameter of approximately 0.78 inches or an internal channel having a diameter of approximately 0.58 inches or other dimensions to correspond to or receive various sized grounding rods. Clearly, however, other sized diameters or other shaped openings may be provided without affecting the scope of the present invention.

Figure 8:
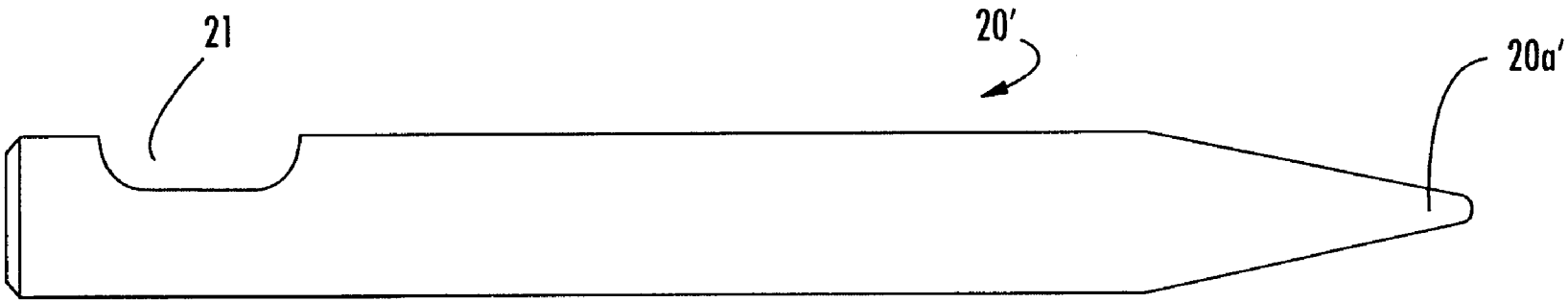

Optionally, and as shown in FIG. 8, the grounding rod driving bit may be replaced with a rock breaking bit or member 20', which has a tapered or pointed or narrowed end or tip 20*a*'. The rock breaking bit 20' may be used to strike and impact and break rocks or concrete or the like using driving assembly 10 in a similar manner as discussed above. Other bits or driving members or the like may be implemented for other applications of the driving assembly, without affecting the scope of the present invention.

As can be seen in FIGS. 7 and 8, each of the driving bits 20, 20' has a mounting or securing region 21 for securing the driving bit within driving device 16. In the illustrated embodiment, the mounting portion 21 is a notched region or cutaway region at the upper end of the driving rod. The mounting portion 21 may be inserted into driving device 16 and may be retained therein via a bolt or mounting member extending through a lower portion of driving device 16 and engaging or being received within the mounting portion 21 of the driving bit. The bit mounting member may be readily loosened and removed from the driving device to facilitate removal and replacement of the driving bit at the end of the driving device. The bit mounting member may be accessible from the front or rear of the driving device, or may be accessible when the cover plates 50 are removed from the sides of the driving device.

Figure 10:
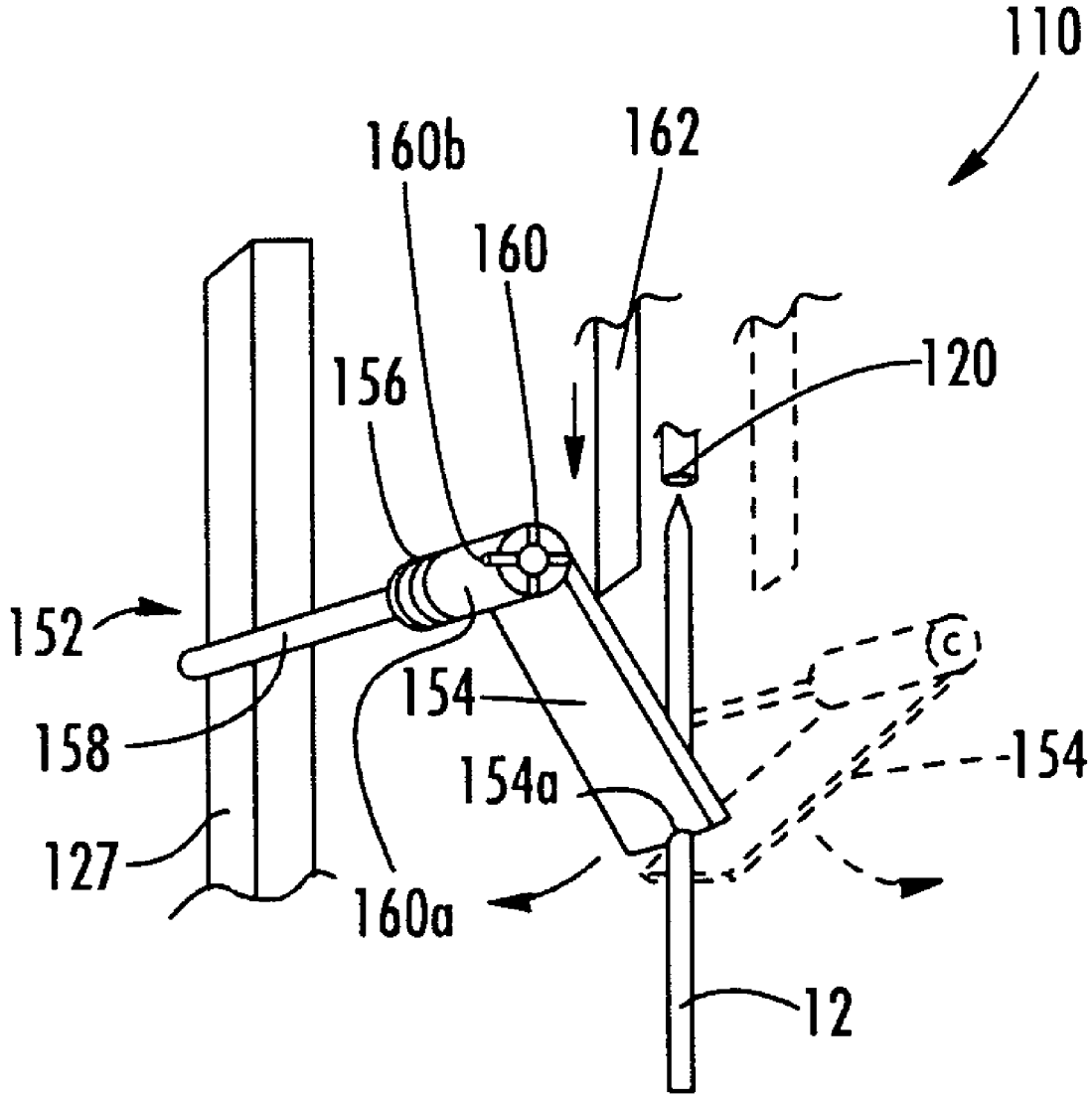
FIG. 10 is a perspective view of one of the guide assemblies of the grounding rod driving assembly of FIG. 9.

Optionally, and with reference to FIGS. 9 and 10, a driving machine or assembly 110 may be mounted to a movable support or platform or wheeled vehicle 118, such as a trailer or truck or the like, and thus may be positioned with its lower end generally at ground level. Driving assembly 110 may include a support frame 114 and a driving device 116, which may be slidable along the support frame 114 to drive a grounding rod 12 into the ground 13. Support frame 114 may be mounted to the wheeled vehicle 118 and may be pivotally mounted to the wheeled vehicle and pivotable about a generally horizontal pivot axis 114*a* to facilitate pivoting of the driving assembly 110 between a generally vertically oriented position (as shown in FIG. 9) and a tilted or stored or storage of generally horizontal position (not shown) along the bed of the trailer or truck when the driving assembly is not in use. The driving assembly 110 thus may be readily transported or moved or driven to a desired location and pivoted to the upright or in use position at the location where the grounding rod is to be driven into the ground.

Driving device 116 is substantially similar to driving device 16, discussed above, such that a detailed description of the driving device will not repeated herein. Driving device 116 may be slidably positioned along a center vertical support 126 of support frame 114, such that driving device 116 may move or slide downward along vertical support 126 as driving device 116 drives the grounding rod into the ground. The driving device may be secured to one or more collar assemblies or other types of sliding assemblies that slidably engage or receive the vertical support to slidably mount the driving device to the vertical support. Support frame 114 further includes a pair of side supports 127 which are connected between upper and lower cross members 124*a*, 124*b*, which are secured to the opposite ends of the middle or center vertical support 126, whereby upper cross member 124*a* may provide an upper or overhead support for vertical support 126.

As can be seen with reference to FIG. 9, center vertical support 126 may include a chain or track 125, which may be positioned along or routed around the vertical support 126. Driving device 116 may be connected to chain 125, such that upward movement of the chain (such as in response to a hydraulic motor or the like 123 mounted at the support frame 114) may cause upward movement of driving device 116 to move or reposition the driving device to the upper portion or end of the support frame 114.

Accordingly, driving device 116 may be initially positioned at or near the upper end or cross member 124*a* of support frame 114 and may be generally aligned with an upper end of a grounding rod 12 at the driving bit 120. As driving device 116 is actuated, driving device 116 hammers or impacts or pounds or drives the grounding rod downward into the ground, while driving device 116 may also slide or move downwardly along vertical support 126, such as in a similar manner as discussed above with respect to driving assembly 10. After driving device 116 has driven the grounding rod substantially downward so that driving device is positioned generally at or near the lower end or cross member 124*b* of the support frame 114, driving device 116 may be raised upward, such as via actuation of the motor 123 to pull or move chain 125 upward along vertical support 126, such that driving device 116 may again be positioned at the upper end or portion of support frame 114. A second grounding rod section may be positioned between the upper end of the first grounding rod section and the driving bit 120 of the raised driving device 116, and the process may continue to drive the grounding rods further into the ground. The process may be repeated as many times as necessary to drive the grounding rods the desired or appropriate or necessary distance into the ground.

As shown in FIGS. 9 and 10, the side vertical supports 127 of support frame 114 may include one or more pairs of guides or rod holders or guide assemblies 152 for guiding or holding or supporting the grounding rod as the grounding rod is driven into the ground by the driving device 116. The guide assemblies 152 may include guide members or plates 154, which are pivotally or adjustably or movably mounted to side support 127 and are pivotable or movable between a supporting position, where the guide members or plates 154 engage the grounding rod to hold or support the grounding rod in a substantially vertical orientation at or below the driving bit 120 of driving device 116, and a disengaged position, where the guide members 154 are moved away from the grounding rod to allow the driving device to move along the center vertical support 126 and past the guide assemblies 152. As shown in FIG. 10, the guide members 154 may include a notch 154*a* at their end for partially receiving the grounding rod 12 therein to hold the grounding rod in the desired orientation beneath the driving bit 120.

The guide members 154 may be mounted to or secured to the side supports 127 via a mounting rod or member 158, as shown in FIG. 10. In the illustrated embodiment, the guide members 154 may be adjustable and may be substantially fixed in each of their positions via a detent or locking mechanism 160. For example, locking mechanism 160 may comprise a collar portion 160*a* and a locking pin or pins 160*b*. Collar portion 160*a* may be pivotally mounted to mounting rod 158 and welded or attached to guide member 154, while locking pin 160*b*, may be generally fixedly mounted at the end of the mounting member 158. Collar portion 160*a* may have notches for receiving locking pin or pins 160*b* to substantially lock or retain the collar portion relative to the mounting rod 158. A biasing member or spring 156 may be provided to bias the collar portion 160*a* toward and into engagement with locking pins 160*b* to retain collar portion 160*a* relative to pins 160*b* and mounting rod 158. When a sufficient downward force is exerted on the guide members 154, the collar portion 160*a* may disengage from the pins 160*b* and the guide members 154 thus may be disengaged or moved from their support position and may move to their non-supporting position, where the guide members may again be substantially locked or secured in that position via the detent mechanism to retain the guide members away from the grounding rod and driving device. As shown in FIGS. 9 and 10, driving device 116 may include a pair of side plates or members 162, which may extend downward beyond the lower end of the driving bit 120 and may engage the guide members 154 and push the guide members downward out of their raised or guiding position, such that the guide members may be moved out of the way of the driving device 116. Driving device 116 thus may continue downward along the vertical support 126 as the driving device continues to drive the grounding rod into the ground, without further contact with the guide members.

The guide assemblies 152 thus may function to hold the grounding rod in position as the driving device drives the grounding rod into the ground such that minimal or no manual holding of the grounding rod is required. The grounding rod may be positioned generally beneath the driving device and generally aligned with the driving bit, and the guide members may be pivoted toward and into engagement with the grounding rod and substantially fixed in such a position to hold the grounding rod or guide the grounding rod as the grounding rod is driven into the ground by the driving device 116. The guide members may be readily moved out of the way of the driving device as the driving device approaches the guide members and contacts the guide members with the side plates 162. Although shown as a pair of pivotable plates or members, other means for selectively engaging and guiding and supporting the grounding rod as the driving device drives the grounding rod into the ground may be implemented with the driving assembly, without affecting the scope of the present invention. For example, other forms of guide members or devices may be mounted along the side supports and may selectively or occasionally engage and support the grounding rod until the driving device has driven the rod a sufficient amount into the ground, without affecting the scope of the present invention.

Therefore, the present invention provides a grounding rod driving assembly or machine or system or rock breaking assembly or machine or system that includes a driving device, such as a hydraulic driving device or the like, that may be slidably movable along one or more generally vertically oriented support members as the driving device drives the grounding rod into the ground (or as the rock breaking bit drives into and breaks up rocks or concrete or the like). The vertical support or supports of the driving assembly of the present invention facilitate proper alignment of the driving device with the grounding rod and limit or substantially preclude misalignment or swinging of the driving device during operation. The driving assembly may be suspended from an overhead support or crane or the like, whereby the vertical supports may provide balance to the drive assembly to limit such swinging or vibration of the driving device during operation. Optionally, the driving assembly may be mounted to a movable or wheeled support or vehicle, such as a trailer or truck or the like, whereby the vertical support may be adjusted or moved or positioned to be in a generally vertical orientation and the driving device may be positionable at an upper end of the vertical support and operable to drive a grounding rod down into the ground as the driving device slides downward along the generally vertical support.

The present invention thus provides for downward sliding and guided movement of the driving device during operation, in order to maintain alignment of the driving device with the grounding rods and to limit or substantially preclude swinging or misalignment of the driving device during operation. The present invention may limit or reduce the number of times the driving device has to be repositioned or adjusted during the process of driving a long length of grounding rod into the ground. Also, the support members or posts of the driving assembly assist in absorbing the impact and vibration upon impact of the driving bit with the grounding rod, and thus may provide for enhanced performance of the driving device and provide for an increase life cycle for the driving device. Because the driving device is maintained in general alignment with the grounding rod, the grounding rod also remains generally vertical and aligned and does not have to absorb as much vibration due to potential misalignment of the driving device.

Changes and modifications in the specifically described embodiments may be carried out without departing from the principles of the present invention, which is intended to be limited only by the scope of the appended claims, as interpreted according to the principles of patent law.

The embodiments of the invention in which an exclusive property or privilege is claimed are defined as follows:

1. A driving machine for driving a driving member against an object, said driving machine comprising:

at least one support member, said at least one support member being supportable by a support structure;

a driving device slidably mounted to said at least one support member and being slidable along said at least one support member, said driving member being movable along said at least one support member generally with said driving device, said driving device being operable to drive said driving member downward to drive said driving member against an object to move or break the object, said driving device being initially positioned at an upper portion of said at least one support member and said driving member engaging the object when said driving device is positioned at said upper portion of said at least one support member, said driving device sliding downward along said at least one support member as said driving member is driven against the object and the object is moved or broken, said driving member impacting the object multiple times while said driving device slides downward along said at least one support member, said at least one support member and said driving device being configured to substantially maintain alignment of said driving member with the object during operation of said driving machine; and said driving device being mounted to a mounting frame that includes at least one collar, said at least one collar slidably receiving said at least one support member to slidably mount said driving device to said at least one support member, wherein said at least one support member includes a stop member at a lower end of said at least one support member, said stop member engaging said at least one collar to limit downward movement of said driving device along said at least one support member.

2. The driving machine of claim 1, wherein said at least one support member comprises a pair of support members, said driving device being slidably mounted between said support members.

3. The driving machine of claim 1, wherein said at least one support member is configured to be suspended from an overhead support.

4. The driving machine of claim 3, wherein said at least one support member is balanced to maintain a generally vertical orientation during operation of said driving machine, said driving device being movable downward along said at least one support member as the object is moved or broken.

5. The driving machine of claim 1, wherein said at least one support member is configured to be mounted to a wheeled vehicle.

6. The driving machine of claim 5, wherein said at least one support member is pivotally mountable to the wheeled vehicle.

7. The driving machine of claim 1, wherein said driving device comprises a hydraulically operated driving device that is operable to oscillate said driving member.

8. The driving machine of claim 1, wherein at least one of said collar and said support member comprises a low coefficient of friction surface at an interface between said collar and said support member.

9. The driving machine of claim 1, wherein said driving member is one of (a) a rod driving member that is configured to engage an end of a grounding rod to drive the grounding rod into the ground and (b) a rock breaking member that is configured to engage and break rock.

10. The driving machine of claim 1, wherein said at least one support member is substantially stationary relative to the object while said driving device drives said driving member into the object and slides downward along said at least one support member.

11. A driving system for driving member against an object, said system comprising:

an overhead support;

a support frame suspended from said overhead support, said support frame including an upper member and at least one support member extending generally downwardly from said upper portion when said upper portion is suspended from said overhead support; and a driving device, said driving device being slidably mounted to said at least one support member and being slidable along said at least one support member, said overhead support being adjustable to position said driving device at the object and at an upper portion of said at least one support member, said driving member engaging the object when said driving device is at said upper portion of said at least one support member, said driving member being movable along said at least one support member generally with said driving device, said driving device being operable to drive said driving member downward to drive said driving member against an object to move or break the object, said driving device sliding downward along said at least one support member as said driving member is driven against the object multiple times and the object is moved or broken, said support frame and said driving device being configured to substantially maintain alignment of said driving member with the object during operation of said driving device;

wherein said overhead support comprises a lifting device operable to lift said support member to position said driving device at an upper portion of the object, said support member being suspended from said lifting device by a flexible member, said support member being substantially balanced to maintain a substantially vertical orientation during operation of said driving device; and said at least one support member comprising a pair of support members extending downward from opposite ends of said upper portion, said driving device being slidably mounted to said support members by a pair of collars that slidably receive said support members, wherein said support members have stops at lower portions thereof, said stops being configured to limit downward movement of said collars to limit downward movement of said driving device relative to said support members.

12. The driving system of claim 11, wherein said overhead support is adjustable to reposition said driving device at said upper portions of said support members after said collars engage said stops.

13. The driving system of claim 11, wherein said at least one support member is substantially stationary relative to the object while said driving device drives said driving member into the object and slides downward along said at least one support member.

* * * * *

UNITED STATES PATENT AND TRADEMARK OFFICE

CERTIFICATE OF CORRECTION

PATENT NO. : 7,063,172 B1
APPLICATION NO. : 10/746974
DATED : June 20, 2006
INVENTOR(S) : Mark C. Marentette It is certified that error appears in the above-identified patent and that said Letters Patent is hereby corrected as shown below:

Column 13:
Line 37, Claim 11, Insert --a driving-- before "member".

Signed and Sealed this

Twenty-fifth Day of November, 2008

JON W. DUDAS
*Director of the United States Patent and Trademark Office*